United States Patent [19]

Baker

[11] Patent Number: 4,845,912

[45] Date of Patent: Jul. 11, 1989

[54] SELF-ALIGNING ARCHITECTURAL PANEL ASSEMBLY

[75] Inventor: Robert F. Baker, Dallas, Tex.

[73] Assignee: Baker Metal Products, Dallas, Tex.

[21] Appl. No.: 143,742

[22] Filed: Jan. 14, 1988

[51] Int. Cl.[4] ..... E04B 5/52

[52] U.S. Cl. ..... 52/483; 52/731; 52/489

[58] Field of Search ..... 52/235, 731, 586, 359, 52/724, 725, 727, 728, 483, 489

[56] References Cited

U.S. PATENT DOCUMENTS 1,754,214 4/1930 Walper ..... 52/359

3,160,245 12/1964 Pavlecka ..... 52/731

3,490,800 1/1970 Wissler ..... 52/586

*Primary Examiner*—James L. Ridgill, Jr.

*Attorney, Agent, or Firm*—Fitzpatrick, Cella, Harper & Scinto

[57] ABSTRACT

An architectural panel assembly for mounting a plurality of panel sections to a structural support member. The assembly includes a mounting bracket fixed along a longitudinal edge of one panel section and fixed to the support member. A fastening bracket is fixed along the edge of another panel section. One of the two brackets has a recess and the other a projection for being received and hooked within the recess. By this structure the two panel sections are connected together and are fixed to the support structure in an easy-to-use process.

9 Claims, 3 Drawing Sheets

SELF-ALIGNING ARCHITECTURAL PANEL ASSEMBLY

BACKGROUND OF THE INVENTION

The present invention relates to architectural accent assemblies and more particularly to panels which are used to cover fixed structures such as the sides of buildings and support columns or the like.

Present day architectural standards require that the support structures for multi-floored buildings must be covered to provide an aesthetically appealing external appearance. The requisite appearance is generally obtained by using panels that may be flat, circular or oval shaped.

Methods and apparatus for attaching such panels to a support column have taken many forms. In one such arrangement, the abutting longitudinal edges of adjacent panel segments are bent at right angles toward the support structure. One of the segments is fastened directly to the column while being provided with a clip on its right-angled face, such clip having an upwardly facing hook thereon. The right angled face of the other panel segment is provided with a slot into which the hook is received, so that the slotted panel segment is hung on the clip-bearing panel segment, which in turn is fixed to the support structure.

Another method and apparatus for joining two sections of a cover assembly uses a turn bolt type of arrangement. Again, the panel segments have right-angle faces which provide longitudinal flanges. Each panel segment has an elongated hole in its flange, and adjacent flanges are positioned with a space therebetween. A pivoting T-shaped clip is inserted in between the panels and rotated to engage each of the panels through the elongated holes. Brackets are fastened to the support structure and the T-shaped clips are then tightened to the brackets by set screws.

A third method and apparatus for joining two cover panel segments includes a keyhole slot type of arrangement. The panel segments are provided with flanges as described above and a screw extends from one flange. The screw has a head with a diameter larger than that of its shank. A slot, in the shape of an inverted keyhole, is provided on the flange of a second segment of the cover for receiving the screw head in a known manner within the large part of the slot. The slotted panel is then lowered so that the narrow portion of the slot engages the shank of the screw.

Each of these arrangements have similar problems in permitting accurate alignment and easy mounting of the panels. In the keyhole slot arrangement, a further problem is encountered in the play which results when the screw does not have the exact length necessary to permit a snug engagement of the flange of the second section. When the screw head does not extend far enough, the cover cannot be set in place, and when it extends too far, the cover remains loosely attached and may vibrate or rattle with any movement of the structure to which it is attached.

A fourth type of arrangement for attaching aesthetically pleasing covers on support structures is one which uses industrial strength velcro. This type of arrangement is extremely expensive and requires a high level of precision for proper positioning of the various portions of the covers. In this method, velcro is attached along the lengths of the support structures and covers, and the cover sections are then pressed in place on the support structure. Once the two elements are joined, they must be separated completely in order to correct any misalignment. Also, since the cover and structure do not securely lock together, an additiona force is required to ensure permanent mating.

In another type of known arrangement in which the sections of column covers are set in place, a two step joining procedure is required. A bracket having slots arranged for enveloping flanges is fixed to the permanent structure. The cover panels have flanges which bend around to provide an abbreviated surface parallel to the main surface of the covering, and the slots on the brackets are configured to receive those abbrviated surfaces. A space is provided between the panels and a plug is inserted in that space for holding the portions of the cover in place. While this type of assembly simplifies installation it leaves a wide gap between sections of a column cover. Furthermore, additional assembly time is required for the multi-step procedure.

All of the foregoing structures require a high degree of accuracy and precision in aligning two sections of the architectural coverings, both in the horizontal and vertical directions, while failing to provide a desirable degree of strength. These difficulties provide for increased installation expenses and undesirable final results.

SUMMARY OF THE INVENTION

Therefore, it is an object of the invention to provide a panel assembly which may be instaled easily and quickly. Additional objects of the invention are to provide a panel assembly which is self aligning and capable of being securely mounted.

The present invention satisfies these objects and provides a solution to the problems of prior art arrangements by providing a unique assembly of mounting brackets. One mounting bracket connects the edge of one cover panel segment to the support structure. This first bracket may be formed by a U-shaped aligning member, and by an L-shaped member affixed to the bridge of the U-shaped member. For example, the L-shaped member may be attached to a longitudinal flange on the panel segment, while the U-shaped member may be fixed to the L-shaped member and is intended to be attached to the support structure by mounting screws. A fastening bracket is fixed to the longitudinal edge of another cover panel segment and has a protruding portion for being received in the open portion of the U-shaped member. The protruding portion of the fastening bracket has a depending hook projection for receipt over a rod fixed between the two legs of the U-shaped member. In this manner the cover panel segment having the fastening bracket attached thereto is supported on the rod, while the mounting bracket embodying the rod, which is fixed to the other cover panel segment, is fixed to the support structure. Furthermore, the width of the protruding portion is only slightly less than the width of the U-shaped opening so that the two brackets may be snugly interlocked. By these means a column may be covered by two semi-circular panel segments by fixing mounting brackets to the opposite longitudinal edges of one panel, and attaching those mounting brackets to the column. The fastening brackets are attached to the two longitudinal edges of the second semi-circular cover panel, and the protruding portions of the fastening brackets are inserted into the U-shaped openings of the mounting brackets and lowered to permit the hooks on the fastening brackets to engage the rods on the mounting brackets. The use of this arrangement provides positive alignment of the sections of the column cover while allowing secure placement of the column cover with respect to the support column. A wall may be covered in the same manner by using flat panels, and by turning the projections and U-shaped members through an arc of 90° with respect to the two section column cover in all cases, the respective U-shaped mounting brackets and the protrucing portions are disposed at angles which permit the panel section to be moved along its center line into its assembly position. thus, if the panel section is curved, the center line is disposed along the center of the arc of the curve; and, if the panel is flat, then the center line is directed through the axis of symmetry of the panel and normal thereto.

DESCRIPTION OF THE PREFERRED EMBODIMENT

Figure 2:
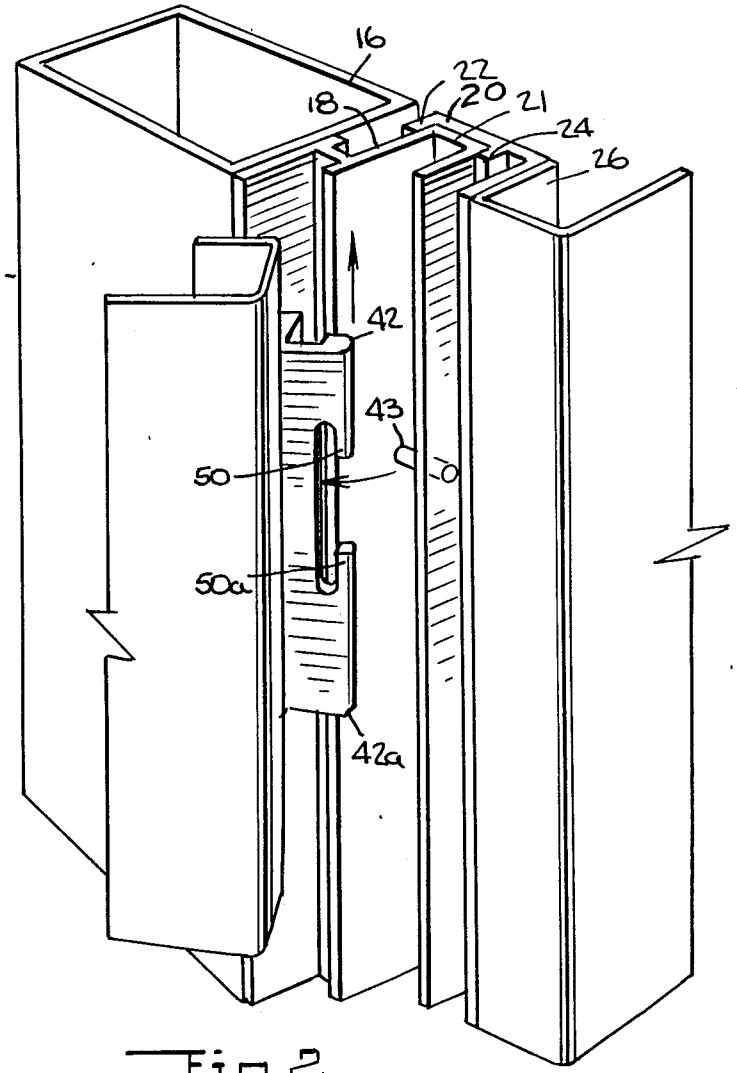
FIG. 2 is a perspective view of the elements illustrated in FIG. 1, wherein one of the half circle column covers is shown disassembled.
Figure 1:
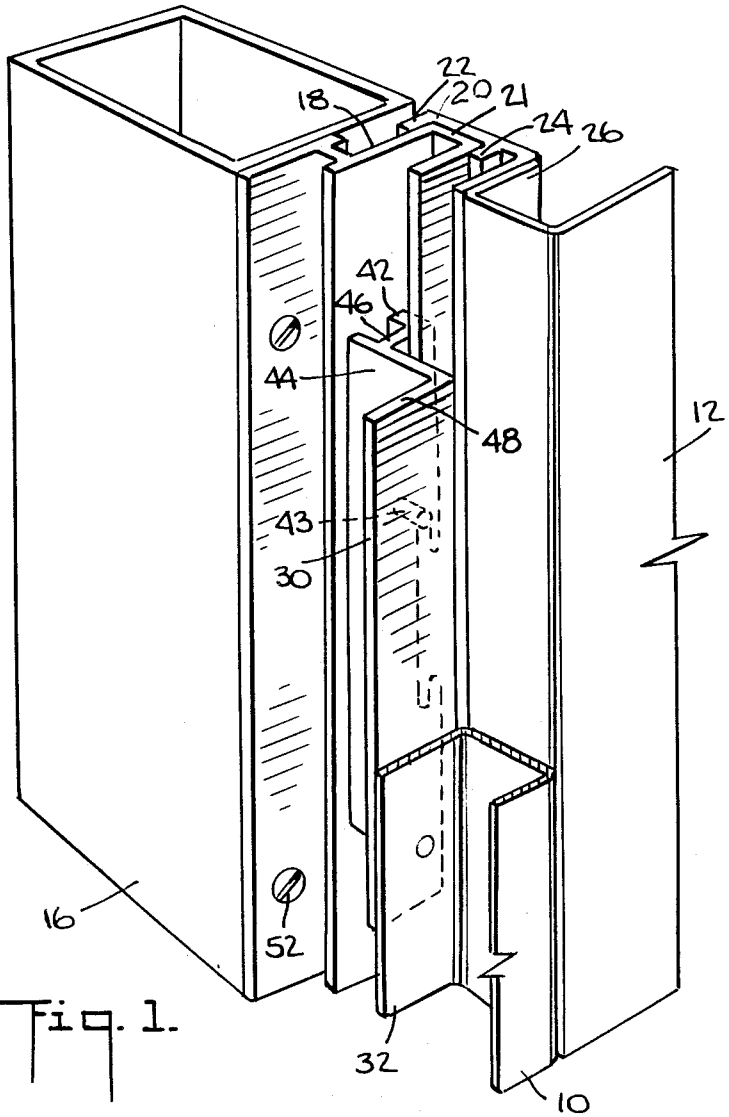
FIG. 1 is a perspective view of an architectural panel assembly used with two half circle column covers.
Figure 3:
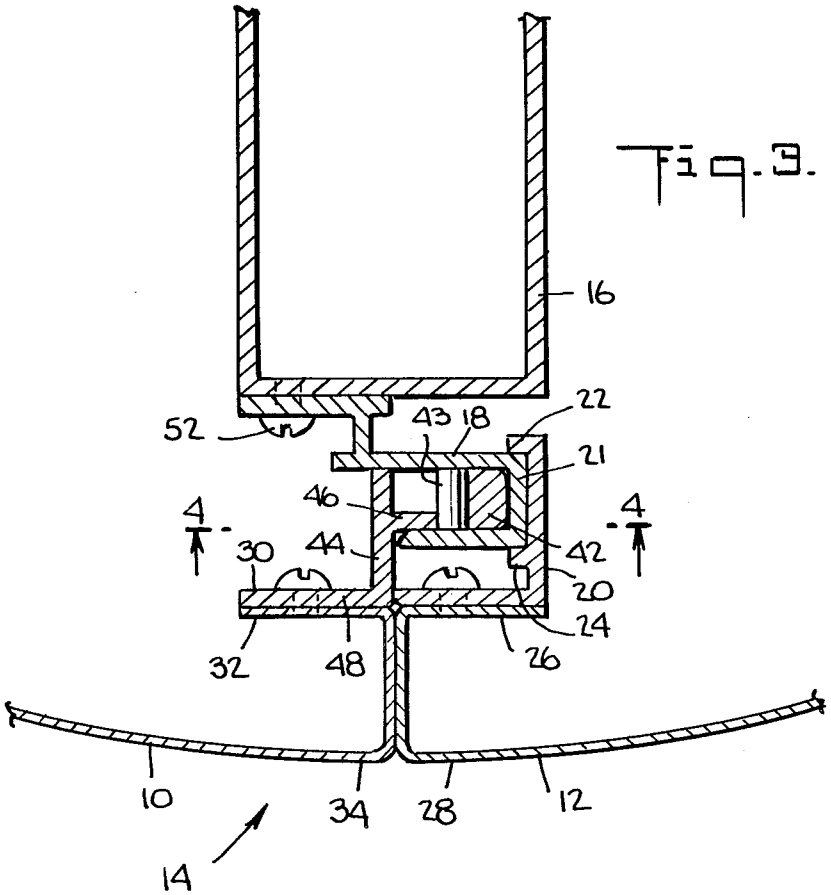
FIG. 3 is a top section view of the assembly of elements shown in FIG. 1.

Referring now to FIGS. 1–3, a first embodiment of the present invention is illustrated as being used to join the two sections of a circular column cover to a structural column. Identical portions of the various figures have been identified with the same numerals in order to simplify the description of the present invention. Portions having similar purposes have been designated using the same numerals with a prime or double prime added.

In FIGS. 1–3, the present invention is illustrated in conjunction with the joining of two semi-circular sections 10 and 12 of a column cover 14. A support column 16 is shown as being generally square in shape, however, any shape of a fixed structure may be adapted to the use of the present invention as long as it has a surface for attachment. Fixed to support structure 16 is a U-shaped member 18 having a double angled arm. Coupled to U-shaped member 18 is a right angled bracket member 20 adapted for receiving the bridge portion 21 of the U-shaped member between fingers 22 and 24. Bracket 20 is mounted on a flange 26 which may be formed by double right angle bends in the longitudinal edge of the panel section 12. Accordingly, the flange 26 extends in parallel with the external surface 28 of semicircular section 12. As a result, the U-shaped member 18 and angled member 20 which are fixed together, as by screws, combine to form a mounting bracket for joining the panel section 12 to the support column 16. A fastening bracket 30 is attached to a flange portion 32 of semicircular column cover 10. Flange portion 32 extends parallel to the external surface 34 of semi-circular section 10 in the same manner as flange portion 26 of semicircular section 12. One end 48 of the bracket 30 is attached to flange 32 while the opposed end thereof is received by the opening of the U-shaped member 18. Specifically, the opposed end of the bracket 30 has a projection 42 having a depending hook 50 (shown in FIG. 2) which engages a screw or rod 43 connected across the legs of the U-shaped member. The projection 42 on the opposed end of bracket 30 has a width which is disposed in parallel with a connecting base 44 of the bracket 30. Projection 42 and base 44 are joined by leg 46, and base 44 extends across the entire open face of the U-shaped member and connects to the tab 48 fixed to the flange 32. With this arrangement, stability is provided between the fastening bracket 30 and the U-shaped member 18, wherein the width of projection 42 extends across and is engageable with both interior faces of the U-shaped member, and one end of base 44 is braced against one of those faces, as shown in FIG. 1.

Figure 4:
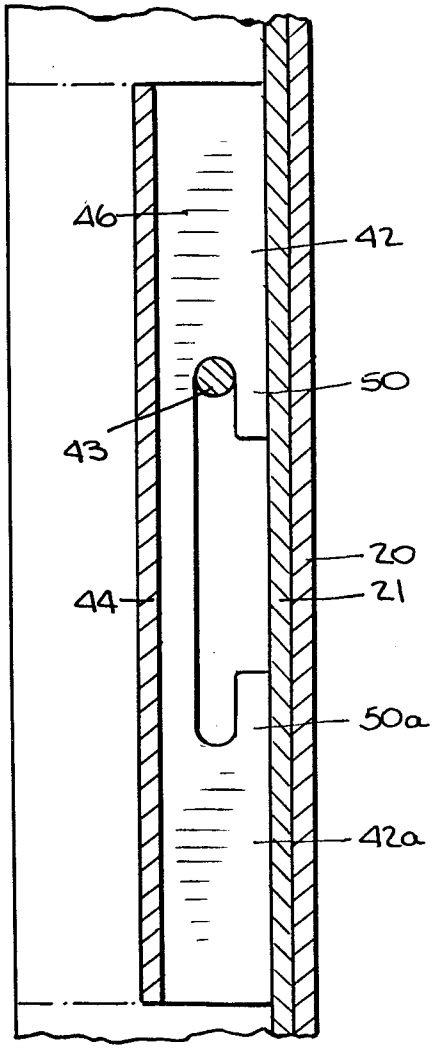
FIG. 4 is a sectional view taken in the plane 4—4 of FIG. 3.

As shown in FIG. 2, the hook 50 o nthe projection 42 of the fastening bracket 30 is reversed and duplicated at the lower end (see elements 42*a* and 50*a*, respectively) of element 30, so that the entire element may be inverted and used on the opposite longitudinal edge of panel segment 10. The assembled engagement between the fastening bracket 30 and the U-shaped member 18 is illustrated in FIG. 4.

In accordance with a preferred use of the invention, when the support beam is to be surrounded by semicircular sections 10 and 12 to form the column cover 14, both longitudinal edges of section 12 have the brackets 18, 20 attached thereto. For example, the bracket 18, 20 as shown in FIG. 3 would merely be inverted for attachment to the opposed longitudinal edge of the section 12. The attaching members 20 of the brackets extend along the entire length of the edges, while the U-shaped members 18 are divided into sections about 12 in. in length spaced along the entire longitudinal extent of the attaching member 20. Fastening bracket 30 may be formed in 6 in. lengths, the number of such lengths corresponding to the number of rods 43 provided across the U-shaped members. The bracket portions 30 are attached to both longitudinal edges of the panel section 10, and, preferably, all of the mounting and fastening components 18, 20 and 30 are properly and accurately aligned and fixed to the panel sections 10 and 12 at the factory. Then, at the construction site panel section 12 is first attached (using the bracket assembly 18, 20) to the column 16 as by screws 52, and panel section 10 is then fastened in place. Specifically, panel section 10 is engaged with section 12 in a slightly raised position so that when the projections 42 on the the several bracket sections 30 are received in the U-shaped element 18, the hooks 50 will clear the rods 43 and will be received in slots defined by the space between the rods and the base portions of the U-shaped recess. When the projections 42 are seated fully in the U-shaped member, the panel section 10 is lowered to fasten the hooks 50 on the rods 43 to complete the assembly. The insertion of the projection 42 is facilitated by the rounded outer corners, and support is given for the interconnection of the brackets by means o fthe engageability of the inner faces of the U-shaped member 18 with the projection faces 42, 46, and the end of base 44.

In this manner, with fastening bracket 30 having projection 42 held between the arms of the U-shaped member 18, the self-aligning feature of the invention is accomplished. Through the use of this feature, the requirement for very sensitive horizontal alignment during the installation of column cover assemblies can be eliminated. Section 10 merely has to be generally in line with section 12 to permit successful and accurate installation.

Figure 5:
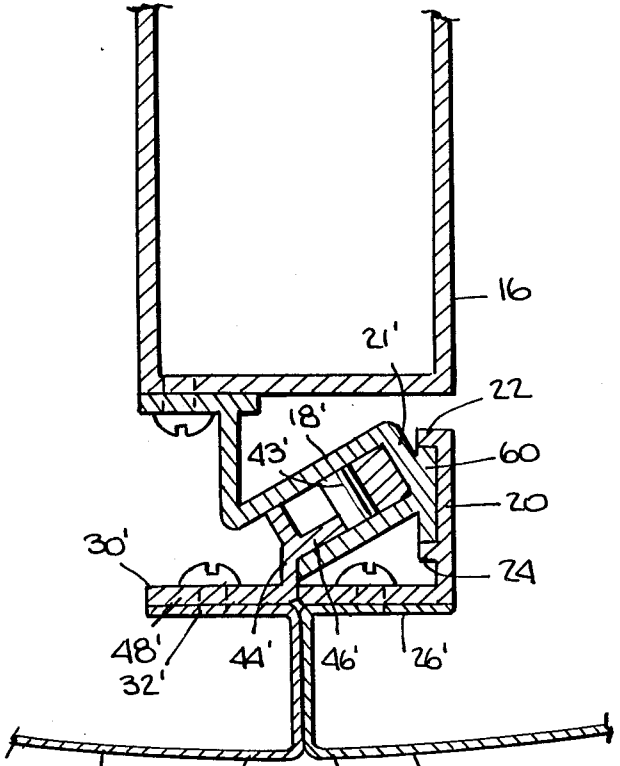
FIG. 5 is a view similar to FIG. 4, but showing mounting elements for use with a column cover which is divided into three sections.

Referring now to FIG. 5, the present invention is illustrated with reference to a column cover which is divided into three sections, which may include, for example, panel sections 10' and 12' as shown. In order to provide the self aligning feature of the present invention, in this embodiment, U-shaped member 18' is disposed at an angle of 60° with respect to the connecting portion of bracket 20. This is accomplished by adding an element 60 to the bridge portion 21' of the U-shaped member 18', wherein that element 60 is received between fingers 22, 24 of member 20. In this regard, projection 42' forms an angle of approximately 30° with the mounting portion 48' of the fastening bracket 30', so that the projection 42' can be readily received in the U-shaped member 18'. Also, a portion of member 44' is angled to bear against the inner face of the U-shaped member 18' for support.

Figure 6:
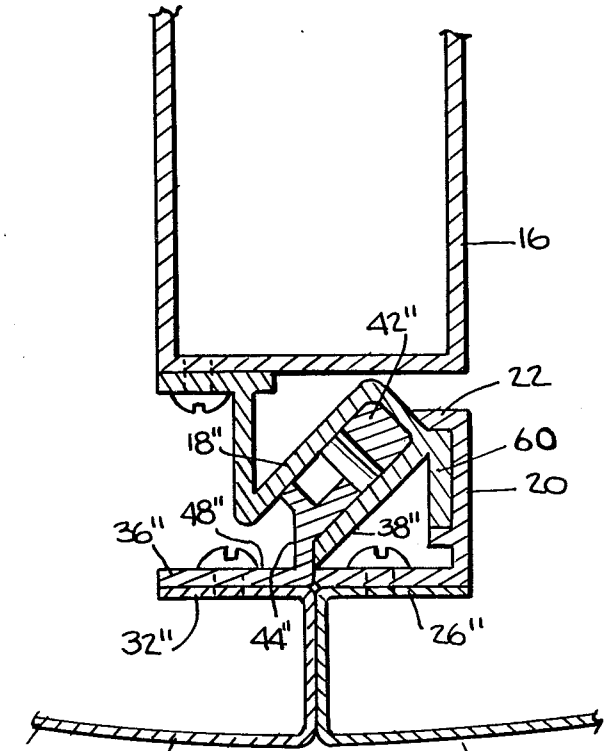
FIG. 6 is a view similar to FIG. 4, but showing mounting elements for use with a column cover which is divided into four sections.

In FIG. 6, the present invention is illustrated in conjunction with a column cover 14'' which is divided into four sections. As distinguished from the description regarding FIG. 3, U-shaped member 18'' is configured to provide a 45° angle with respect to element 20. Again, an element 60'' is formed integrally with the bridge portion of the U-shaped member 18', and that element 60'' is received between the fingers 22, 24 of bracket 20. Similarly, projection 42 forms a 45° angle with portion 48'' of bracket 30'. The outer portion of base 44'' is also angled at 45° to be supported against an inner face of the U-shaped member 18'. The operation of this arrangement of the present invention is similar to that of the operation of the arrangements of FIGS. 1 and 3. Thus, when a column cover 14'' is divided into four sections, the approach angle changes and the interlocking members are set at 45° in order to maintain the self-aligning feature.

In all three arrangements of the described preferred embodiment, bracket part 20 may remain the same, while the angles of U-shaped member 18 and fastening bracket 30 are varied to maintain the self-aligning feature of the present invention. That is, the installation of two, three or four section column covers is similar, in that the panel sections carrying the fastening brackets are set in place by moving them toward the column in a direction normal thereto so that they can be set in place with ease.

The preferred embodiment of the invention is also applicable to flat panels used to cover a straight surface. In this case, the arms of the U-shaped member are disposed in parallel with the extending wall of the bracket 20, and the projection of the fastening bracket is disposed at a right angle, with respect to its mounting portion 48. Again, by the means described herein, each of the panels may be mounted by moving it, toward its final assembled position, in a direction along its center line of curvature.

Figure 7:
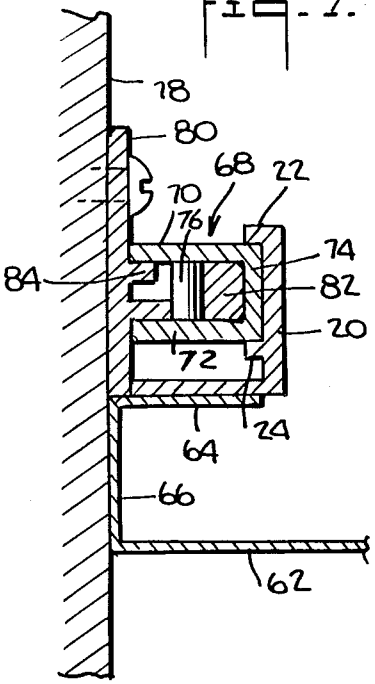
FIG. 7 is a view similar to FIG. 4, but showing a jamb mounting for a half circle panel segment.

Referring now to FIG. 7, another embodiment of the present invention is illustrated for attaching a semicircular architectural panel to a wall. In FIG. 7 the architectural panel 62 has a flange 64 formed by a double bend along its longitudinal edge, and its opposed longitudinal edge may be formed in the same manner. Attached to flange 64 is bracket 20 having fingers 22 and 24 for receiving the base 74 of a U-shaped member 68 having arms 70 and 72. A rod 76 connects arms 70 and 72. A plate 80 is bolted to the wall, and extending out from plate 80 and perpendicular to its surface are projection 82 and tab 84. Projection 82 includes an upwardly facing hook which receives and supports the rod 76. In the same manner as the embodiments of FIGS. 1, 3 and 4, the projection 82 fits snugly against the walls of the U-shaped member, and the tab 84 projects from the plate 80 in parallel with the projection 82, wherein the elements 84 and 82 are spaced part to fit snugly within the walls of the U-shaped member. Thus, in this embodiment of the invention, bracket 20 is fixed to architectural panel 62, and bracket 20 receives U-shaped member 68 between fingers 22 and 24 and is attached thereto by screws. Panel 62 is then placed at an elevation which is slightly higher than its final assembled position and rod 76 is inserted over the hook of projection 82. Panel 62, to which rod 76 is attached, is then lowered into position so that it is received and supported by the hook of element 82. In this manner, architectural panel 62 may be locked into position without the necessity of precise horizontal positioning maneuvers. Projection 82 and U-shaped member 68, provide accurate alignment of U-shaped member 68 to which panel 62 is attached.

In practicing the present invention as set forth in the foregoing embodiments, large and bulky architectural panels and column covers may be easily set in place through the self-aligning feature of the present invention. Preferably, the brackets 20 are continuous along the length of the panel, while the U-shaped members 18, 18', 18', and 68, along with the bracket 30 and the plate 80 may be 6 in. to 12 in. in length and may be placed at spaced apart positions along the height of the support column, wall, etc., upon which they are to be attached. This arrangement provides maximum strength while minimizing the amount of weight added to the column covers or panels. Through the use of the present invention, a relatively simple, lightweight apparatus is provided by which architectural panels or column covers may be put in place quickly, easily and accurately, thereby permitting maximum efficiency of construction time.

Thus, it is apparent that there has been provided in accordance with the present invention, a self-aligning architectural panel assembly that fully satisfies the objects, aims and advantages set forth above. While the invention has been described in conjunction with specific embodiments thereof, it is evident that many alternatives, modifications and variations, will be apparent to those skilled in the art in light of the foregoing description. Accordingly, it is intended to embrace all such alternatives, modifications and variations as fall within the spirit and scope of the appended claims.

What is claimd is:

1. A panel attachment assembly for securing a plurality of panel sections to a fixed structure comprising:

a plurality of panel sections;

a mounting bracket fixedly coupled to a longitudinal edge of a first said panel section, wherein said mounting bracket is for being fixedly attached to said fixed structure; and a fastening bracket fixedly coupled to a longitudinal edge of a second said panel section for locking engagement with said mounting bracket, wherein one of said mounting and fastening brackets has a U-shaped portion and the other of sad brackets has a corresponding projecting portion for insertion in said U-shaped portion, and wherein said U-shaped and projecting portions of said brackets include hook and slot means for effecting said locking engagement directly between said mounting and fastening brackets.

2. A panel attachment assembly according to claim 1, wherein said panel sections are flat and said U-shaped portion is disposed normal to the plane of said panels.

3. A panel attachment assembly according to claim 1, wherein said panel sections are curved to surround a structural column, and wherein said projecting and U-shaped members are disposed at an angle with respect to the longitudinal edges of said panel to permit sad locking engagement when one of said panels is mounted on the support structure by said mounting bracket, and the panel section bearing said fastening bracket is moved toward said column along a line directed toward a longitudinal center axis of said column.

4. A column cover assembly comprisng:

a plurality of column cover segments;

a mounting bracket fixedly coupled to a longitudinal edge of a first said column cover segment, wherein said mounting bracket is for fixed mounting to a column; and a fastening bracket fixedly coupled to a longitudinal edge of a second said column cover segment for locking engagement with said mounting bracket, wherein one of said mounting and fastening brackets has a recessed portion and the other of said brackets has a corresponding projecting portion for insertion in said recessed portion, and wherein said projecting and recessed portions of said brackets include hook and slot means for effecting said locking engagement directly between said mounting and fastening brackets.

5. A column cover assembly according to claim 4, wherein said cover segments are curved and said projecting and recessed portions are disposed at an angle with respect to said longitudinal edges to permit said locking engagement when one of said cover segments bearing said fastening bracket is moved toward said column along a line passing through a center line of curvature of said one cover segment and through a longitudinal axis of said column.

6. A column cover assembly according to claim 4, wherein said recessed portion is arranged in a U-shape having legs interconnected by a base member, and wherein said U-shaped portion receives said projecting portion, said U-shaped portion having a rod extending across the legs thereof to form said slot means between the rod and the base member.

7. A column cover assembly according to claim 6, wherein said U-shaped portion forms a part of said mounting bracket, and wherein said hook means forms a part of said fastening means, said hook means including a downwardly facing hook member which is received over said rod.

8. A column cover assembly according to claim 7, wherein said mounting bracket extends along the full height of said column cover segment and is provided with a plurality of said rods.

9. A column cover assembly according to claim 8, wherein said monting bracket includes a plurality of said U-shaped portions spaced apart along its length, and wherein each said U-shaped portion includes a said rod.

* * * * *

UNITED STATES PATENT AND TRADEMARK OFFICE

CERTIFICATE OF CORRECTION

PATENT NO. : 4,845,912

DATED : July 11, 1989

INVENTOR(S) : ROBERT F. BAKER

It is certified that error appears in the above-identified patent and that said Letters Patent is hereby corrected as shown below:

COLUMN 2

Line 4, "additiona" should read --additional--.
Line 13, "abbrviated" should read --abbreviated--.
Line 30, "instaled" should read -installed--.

COLUMN 3

Line 9, "cover in" should read --cover. In--.
Line 10, "protrucing" should read --protruding--.
Line 13, "thus," should read --Thus,--.
Line 28, "FIG. 4," should read --FIG. 3,--.
Line 31, "FIG. 4," should read --FIG. 3,--.
Line 34, "FIG. 4," should read --FIG. 3,--.

COLUMN 4

Line 21, "hook 50 o nthe" should read --hook 50 on the--.
Line 63, "o fthe" should read --of the--.

COLUMN 5

Line 30, "member 18'," should read --member 18",--.
Line 32, "projection 42" should read --projection 42"--.
Line 35, "member 18'." should read --member 18".--.

UNITED STATES PATENT AND TRADEMARK OFFICE

CERTIFICATE OF CORRECTION

PATENT NO. : 4,845,912

DATED : July 11, 1989

INVENTOR(S) : ROBERT F. BAKER

It is certified that error appears in the above-identified patent and that said Letters Patent is hereby corrected as shown below:

COLUMN 6

Line 7, "4" should read --5--.
Line 33, "18', 18'," should read --18', 18",--.
Line 56, "claimd" should read --claimed--.

COLUMN 7

Line 15, "sad" should read --said--.

COLUMN 8

Line 30, "monting bracket" should read --mounting bracket--.

Signed and Sealed this

Nineteenth Day of November, 1991

*Attest:*

HARRY F. MANBECK, JR.

*Attesting Officer*

*Commissioner of Patents and Trademarks*